US007137262B2

(12) United States Patent
Carter

(10) Patent No.: US 7,137,262 B2
(45) Date of Patent: Nov. 21, 2006

(54) SUPPLEMENTAL HEAT CONTROL APPARATUS AND METHOD FOR FREEZER/REFRIGERATION EQUIPMENT

(75) Inventor: David Carter, Asheville, NC (US)

(73) Assignee: Kendro Laboratory Products, LP, Newtown, CT (US)

( * ) Notice: Subject to any disclaimer, the term of this patent is extended or adjusted under 35 U.S.C. 154(b) by 0 days.

(21) Appl. No.: 10/727,599

(22) Filed: Dec. 5, 2003

(65) Prior Publication Data

US 2005/0120728 A1 Jun. 9, 2005

(51) Int. Cl.
*F25D 21/04* (2006.01)

(52) U.S. Cl. ..... 62/150; 62/156; 62/248; 62/273; 62/275

(58) Field of Classification Search ..... 62/150, 62/140, 275, 248, 175, 277, 278, 279, 273, 62/156

See application file for complete search history.

(56) References Cited

U.S. PATENT DOCUMENTS

| | | | | | |
|---|---|---|---|---|---|
| 4,127,765 | A | * | 11/1978 | Heaney | 62/150 |
| 4,192,149 | A | * | 3/1980 | Webb | 62/277 |
| 4,260,876 | A | * | 4/1981 | Hochheiser | 219/497 |
| 4,389,856 | A | * | 6/1983 | Ibrahim | 62/278 |
| 5,542,258 | A | * | 8/1996 | Shim | 62/150 |
| 5,778,689 | A | * | 7/1998 | Beatenbough | 62/248 |

* cited by examiner

*Primary Examiner*—Harry B. Tanner
(74) *Attorney, Agent, or Firm*—Baker & Hostetler LLP

(57) ABSTRACT

A method and apparatus that provides supplemental heat from a heat source based upon the operating environment of a refrigeration or freezer. The supplemental heat is automatically controlled to provide heating to a sealing area to prevent condensation from forming.

15 Claims, 3 Drawing Sheets

SUPPLEMENTAL HEAT CONTROL APPARATUS AND METHOD FOR FREEZER/REFRIGERATION EQUIPMENT

FIELD OF THE INVENTION

The present invention relates generally to the control of heating functions of an air temperature control system. More particularly, the present invention relates to providing supplemental heat from a heat source based upon the operating environment of refrigeration or freezer equipment.

BACKGROUND OF THE INVENTION

Under certain operating conditions, undesirable condensation can occur on the outside surface of freezer/refrigeration equipment. The condition may exist when the freezer/refrigeration equipment having a lower internal temperature is operated in an ambient environment of elevated temperature and elevated relative humidity. The outside surface of the freezer/refrigeration equipment generally remains cold and the air film about the surface is also cold. Since cold air can not contain as much moisture as warm air, it separates out and settles in a liquid phase on the cold surface(s). Once the phase change occurs, from vapor to liquid, changing the liquid back to vapor generally takes a long time due to additional energy requirements necessary to achieve a phase change.

The result of the phase chance, from vapor to liquid, on a freezer/refrigeration surface may be many fold. For instance, condensation may run down from the freezer/refrigeration surface to the floor area and collect to produce a puddle.

Freezer/refrigeration equipment may generally use gasket materials to seal an internal compartment. This compartment may contain specimens which require being subjected to certain operating temperatures for one of a variety of reasons. For example, it may be important to maintain the operating temperature of a specimen in order to preserve the specimen in a prescribed manner or to ensure that it doesn't spoil. Another reason may be to develop cultures within a prescribed operating temperature environment. This operating temperature may be further important for developing the culture at an optimum growth rate for example.

Should condensation develop and/or refreeze along any freezer/refrigeration sealing areas such as a gasket, the gasket may lose its ability to remain flexible in order to seal surfaces completely. Hence, with a seal unable to conform to the surface of the freezer/refrigeration equipment, potential air paths could develop along the gasket surface contact area. This effect could result in the freezer/refrigeration equipment not being able to seal properly and hence, an inability of the freezer/refrigeration equipment to maintain a prescribed operating temperature(s). Thus, a loss of energy and time may result in attempting to generate and maintain an operating temperature of the freezer/refrigeration equipment. Additionally, when the aforementioned gasket looses its flexibility as described, the integrity of the sealing capacity of the inner chamber has the potential to become compromised, and the specimen(s) may become contaminated due to the freezer/refrigeration equipment not being able to maintain a prescribed operating temperature.

Traditional freezer/refrigeration systems may attempt to prevent and/or combat undesirable condensation effects by introducing a supplemental heat source to a back side of a surface likely to form condensation. Traditionally, the heat source can be hot gas routed from the refrigeration system, electrical resistance heaters, or the like. This arrangement is typically configured to provide continuous heating to the freezer/refrigeration system.

However, in practical application, additional heat is often only necessary under certain conditions to prevent the formation of condensation, such as, when the freezer/refrigeration equipment has a lower internal temperature and is operated in an ambient environment of elevated temperature and elevated relative humidity. However, the aforementioned traditional arrangement generally requires the freezer/refrigeration arrangement to continuously overcome the constant supplemental supply of heating in an attempt to prevent condensation from forming on the surface. This kind of set-up is not necessarily the most efficient way to control condensation on freezer/refrigeration surfaces, since additional heat is generally only necessary under certain prescribed conditions. Thus, providing a continuously supply of supplemental heat, without taking into account the operating environment of the freezer/refrigeration equipment, can waste unnecessary energy and drive up the operating/maintenance costs of the freezer/refrigeration system.

Accordingly, it is desirable to provide a method and apparatus that provides supplemental heat from a heat source based upon the operating environment of the freezer/refrigeration equipment. It is further desirable to provide automatic control of the supplemental heat provided to the freezer/refrigeration equipment. It is also desirable to automatically control the operation of providing supplemental heat such that it is only activated under conditions that would promote surface condensation on the sealing surface of freezer/refrigeration equipment.

SUMMARY OF THE INVENTION

The foregoing needs are met, to a great extent, by the present invention, wherein in one aspect an apparatus is provided that in some embodiments includes controlling supplemental heat in a refrigerator or freezer comprising a heating unit, a sensor assembly unit and a switching unit that switches the heating unit on and/or off. The apparatus also provides a control unit that controls the switching unit in response to the sensor assembling unite.

In accordance with another aspect of the present invention, a method is provided that in some embodiments includes reading a first cabinet surface temperature measurement, reading a first ambient temperature measurement, and reading an ambient relative humidity. The method also provides measuring a calculated dew point reading and making a first determination of whether the cabinet surface temperature measurement is at a first acceptable level relative to the calculated dew point measurement. The method further provides for supplying supplemental heat if the first determination is not at the first acceptable level.

In accordance with yet another aspect of the present invention, a system is provided that in some embodiments includes a means for reading a first cabinet surface temperature measurement, a means for reading a first ambient temperature measurement, and means for reading an ambient relative humidity. The system also provides for a means for measuring a calculated dew point reading. The system further provides for a means for making a first determination of whether the first cabinet surface temperature measurements is at a first accepted level relative to the calculated dew point measurement and a means for supplying supplemental heat if the first determination is not at the first acceptable level.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
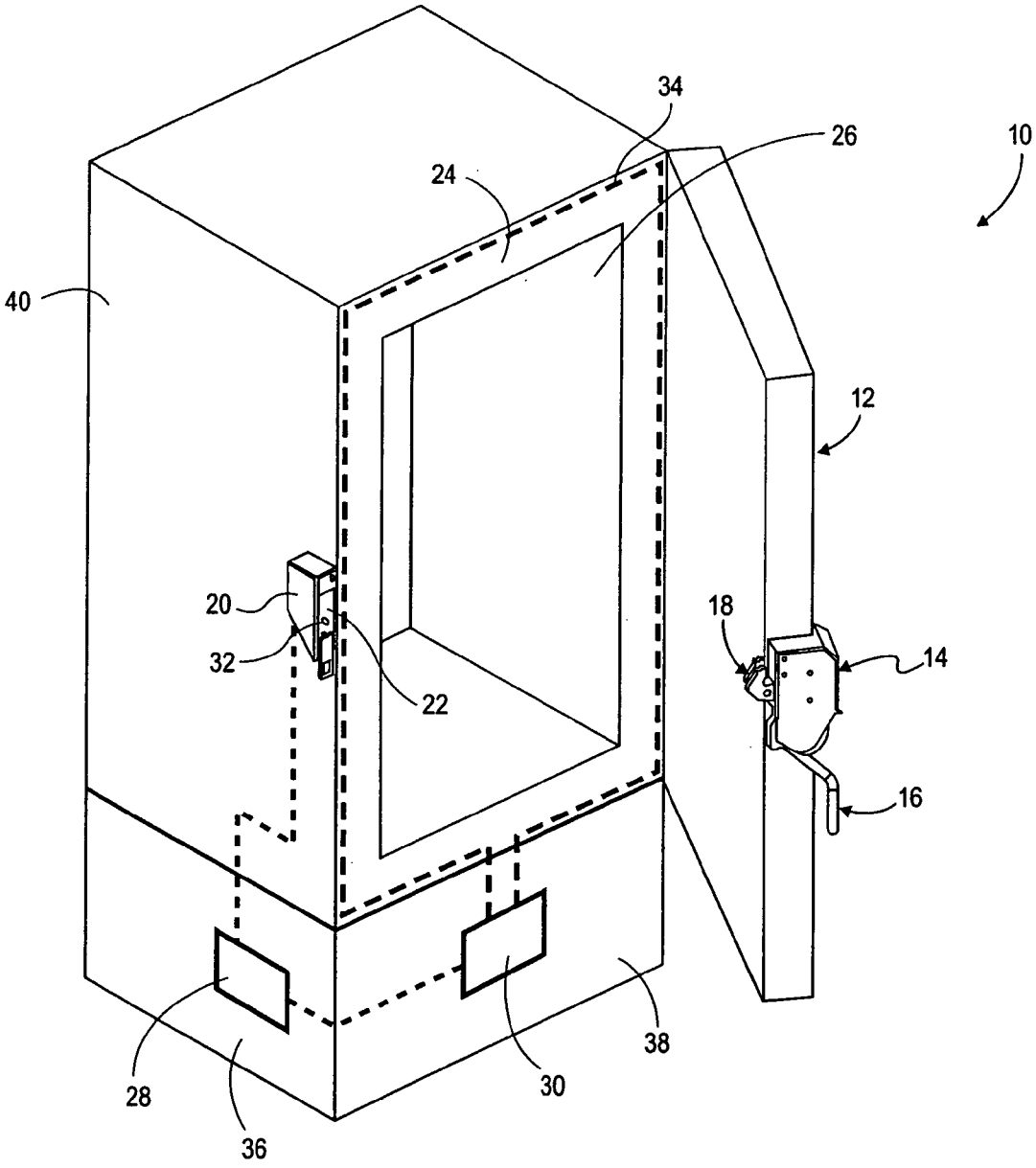
FIG. 1 is a perspective view illustrating supplemental heat system components incorporated into a refrigerator or freezer according to a preferred embodiment of the invention.

An embodiment in accordance with the present invention provides a method and apparatus for mounting external surface temperature of a freezer/refrigeration equipment and other variables such as the ambient temperature and the relative humidity. In a preferred embodiment of the invention, the method and apparatus automatically control the operation of providing supplemental heat such that the supplemental heat is only activated under conditions that would promote surface condensation on the freezer/refrigeration equipment. The invention will now be described with reference to the drawing figures, in which like reference numerals refer to like parts throughout.

An embodiment of the present inventive apparatus is illustrated in FIG. 1 which shows as a refrigerator or freezer equipment 10. The refrigerator or freezer equipment 10 may generally have a door 12 having an installed door latch assembly 14 attached thereto. In a preferred embodiment of the invention, the door latch assembly 14 may have a handle means 16 and a locking mechanism 18 which may be retained within a complementary door latch cover assembly 20 having an interior portion 22. When the door 12 is in a closed position and secured via the door latch assembly 14, a sealing surface 24 of the refrigerator or freezer equipment 10 may serve to retain and maintain an operating temperature within a compartment chamber 26 of the refrigerator or freezer equipment 10. Additionally, the sealing surface 24 may facilitate preventing ambient temperatures from breaching into the compartment chamber 26.

Effective sealing of the compartment chamber 26 may be important for housing specimens requiring subjection to certain operating temperatures for one of a variety of reasons. By way of example, it may be important to maintain the operating temperature of a specimen in order to preserve the specimen in a prescribed manner or to ensure that it doesn't spoil. Another reason may be to develop cultures within a prescribed operating temperature environment. This operating temperature may be further important for developing the culture at an optimum growth rate for example.

Should condensation develop along the refrigerator or freezer equipment, it would most likely tend to develop along the sealing surface 24. Thus, it may be most preferable to prevent and, if possible, concentrate efforts to eliminate the formation of condensation in this area. In a preferred embodiment of the invention, thermal conditions would be evaluated through sensors monitoring external surface temperature of the freezer/refrigeration equipment and other variables such as ambient temperature, and the ambient relative humidity. With the collection and evaluation of sensor data, the surface heat would be automatically activated if and when a set condition approached or reached that which would promote surface condensation. The supplemental surface heat could be configured to supply heat to the freezer/refrigeration equipment via one of a variety of means. One example of supplying the supplemental surface heat may include automatically opening an electromechanical valve to allow the flow of hot refrigerant gas in combination with switching on electrical heaters or the like. The end result is a potential reduction in power consumption over traditional continuous supplemental heat flow set-ups and increased refrigeration component life by reducing the required run time of the refrigeration system.

FIG. 1 further illustrates the basic supplemental heat system components of the preferred invention. These components include a control unit 28, a switching unit 30, a sensor assembly unit 32, and a heating unit 34. The components are shown generally mounted in a preferred location along the refrigerator or freezer equipment at a lower side surface 36, a lower front surface 38, a side surface a cabinet surface 40 and along the sealing surface 24, respectively.

The control unit 28 is generally responsible for receiving information from the sensor assembly unit 32 and for whether a set condition exists that would promote surface condensation. The control unit 28 would further be responsible for enacting the other components of the supplemental heat system components if necessary. For example, should the sensor control unit 28 determine that a set condition approached or reached a state which would promote surface condensation based upon information supplied from the sensor assembly unit 32, the control unit 28 would enact the switching unit 30 to provide supplemental heat via the heating unit 34.

In a preferred embodiment, the supplemental heat would be automatically activated to provide heating to the sealing surface 24. By way of example, the activation of supplemental heat could be generated by opening an electromechanical valve allowing the flow of hot refrigeration gas by switching on electrical heaters.

Figure 2:
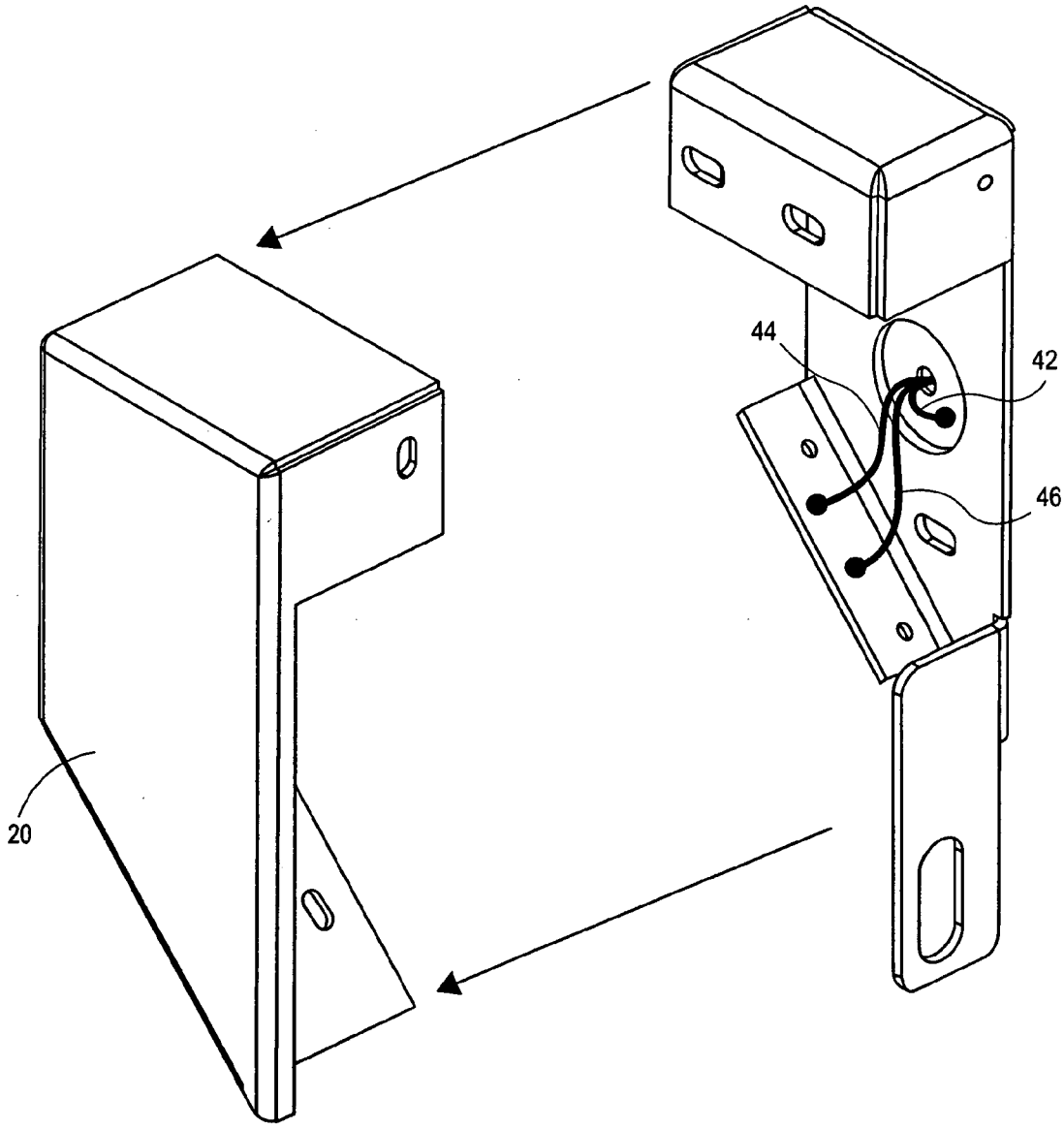
FIG. 2 is an enlarged view of a sensor unit integrated with the door latch cover.

As shown in FIG. 2, the heating unit 34 is designed to generally traverse the sealing surface 24 of the refrigeration or freezer equipment 10 by way of the heating unit 34. By providing supplement heat generally to the sealing surface area, the effects of condensation can be eliminated or prevented in accordance with the present invention.

FIG. 2 illustrates an enlarged view of the sensor assembly unit 32. The sensor assembly unit 32 is composed of a surface temperature sensor 42, an ambient temperature sensor 44, and an ambient relative humidity sensor 46. In a preferred embodiment of the invention, the sensor assembly unit 32 is integrated within the interior portion 22 of the door latch cover assembly 20. An advantage of installing the sensor assembly unit 32 in the inner portion 22 of the hatch door cover assembly 20 includes the benefit of added protection from outside elements which could contact the sensor assembly unit 32 and damage it. The door latch cover assembly 20 also helps localize the measurements of the sensor assembly unit 32 to generally produce more accurate temperature readings. The combination of readings measured by the surface temperature sensor 42, the ambient temperature sensor 44, and the ambient relative humidity sensor 46 will determine whether it is necessary to supply supplemental heat to the sealing surface 24 of the refrigerator or freezer equipment 10.

Figure 3:
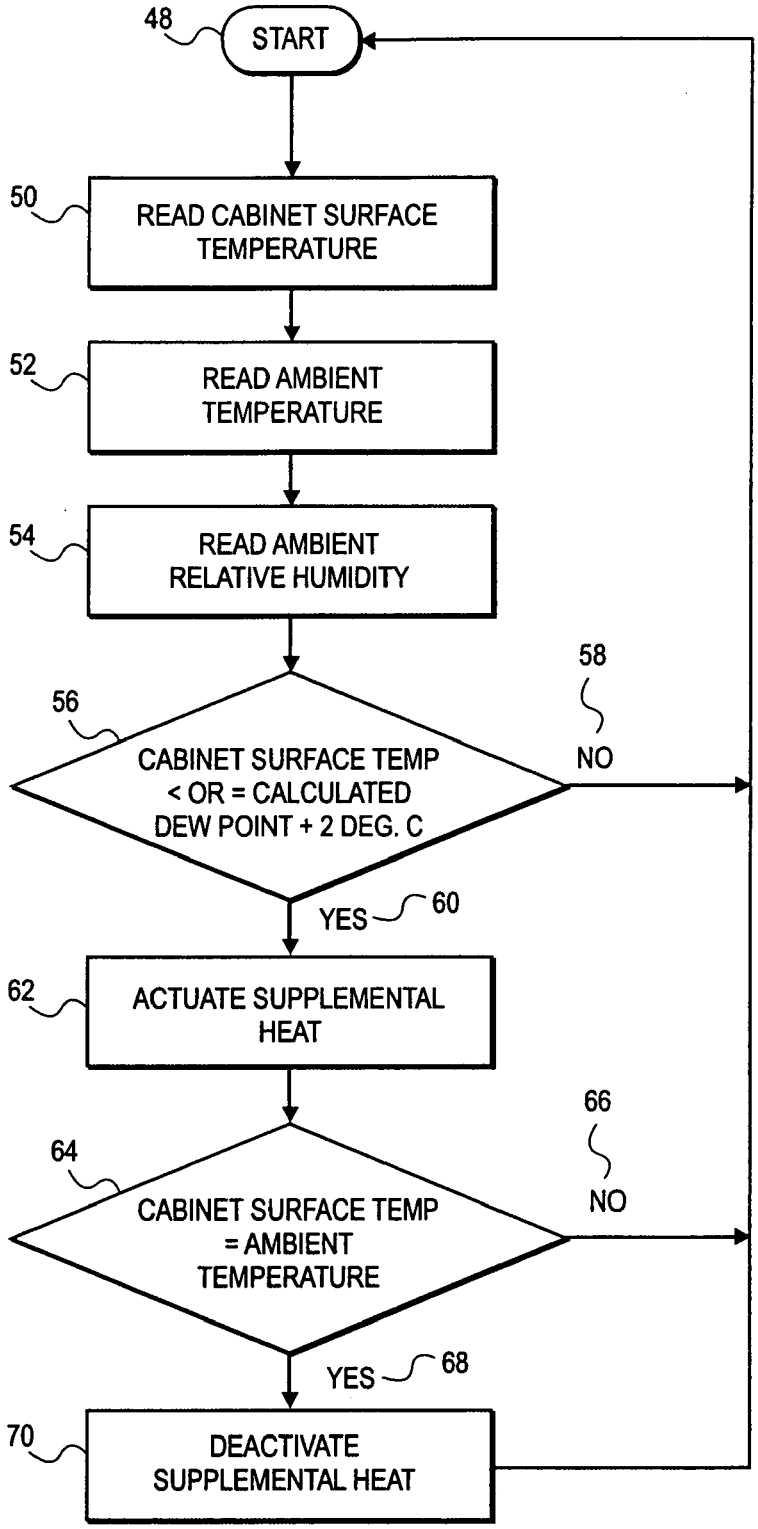
FIG. 3 is a flowchart of a process for testing and supplying supplemental heat to the refrigerator or freezer in accordance with a preferred embodiment of the present invention.

As illustrated in FIG. 3, a flowchart of the process for testing and supplying supplemental heat to the refrigerator or freezer in accordance with a preferred embodiment of the present invention is shown. In operation, the sensor assembly unit 32 begins a process 48 of ascertaining whether a set condition exists to approach or reach a state which would promote surface condensation. A plurality of measurements are made in order to determine whether a condition exists conclusive to promoting condensation along the sealing surface 24.

One of the readings 50 performed by the sensor assembly unit 32 includes a cabinet surface temperature of the refrigerator or freezer equipment 10. The sensor assembly unit also performs a measurement 52 of the ambient temperature and a measurement of the ambient relative humidity 54. Another measurement 56 includes a determination of the cabinet surface and temperature with respect to the dew point plus a 2 degree C.° constant. The cabinet surface temperature is evaluated to determine if it is less than or equal to the dew point plus 2 degrees C.°.

If the cabinet surface temperature is not less than or equal to the dew point plus 2 degrees C.°, the control unit 28 does not activate the switching unit 30 to supply supplemental heat to the sealing surface 29 of the refrigerator or freezer 10. Additional readings to monitor the cabinet surface temperature with respect to the dew point may begin 48 after a negative determination 58 is made.

If the cabinet surface temperature is less than or equal to the dew point plus 2 degrees C.°, a positive determination 60 is made. Based upon the positive determination, the control unit 28 enacts the switching unit 30 to activate supplemental heat 62 to the sealing surface 24 of the refrigerator or freezer equipment 10 via the heating unit 34.

After the supplemental heat is supplied to the sealing surface 24, a measurement is performed 64 to compare the cabinet surface temperature with respect to the ambient temperature. If the cabinet surface temperature is equal to the ambient temperature 38 the control unit 28 will deactivate the supplemental heat 70 by deactivating the switching unite 30. If the cabinet surface temperature is not equal to the ambient temperature 66, supplemental heat will continue to be supplied to the sealing surface 24 via the heating unit 34.

The sensor assembly unit 32 will make continual measurements 48 to re-evaluate a set condition to determine a state which would promote surface condensation. This process may include making additional updated measures of the cabinet surface temperature 50, ambient temperature 52, ambient relative humidity 54, and the cabinet surface temperature with respect to the dew point plus 2 degrees C.°. The constant evaluation of these measurements as described herein will facilitate the determination of whether to supply supplemental heat 60, 62 and when to deactivate the supplemental heat supply 68, 70.

Although an example of the refrigeration or freezer equipment is shown using components of the supplemental heating system at various locations of the refrigeration or freezer equipment, it will be appreciated that the components may be located along other locations as deemed necessary. Also, while a preferred embodiment of the invention automatically supplies supplemental heat by opening an electromachanical valve to allow the flow of heat refrigeration gas by switching on electrical heaters, other heating units 34 may be employed to provide the supplemental heat to the sealing surface 24 of the refrigeration or freezer equipment.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An apparatus for controlling supplemental heat in a refrigerator or freezer comprising:

a heating unit disposed to heat a door seal mating surface of the refrigerator or freezer body, the door seal mating surface having a surface temperature;

a sensor assembly unit configured to output at least a dew point-derived value and an ambient temperature, the sensor assembly comprising;

an ambient temperature sensor;

a surface temperature sensor; and an ambient relative humidity sensor;

a switching unit that switches the heating unit on and/or off; and a control unit that controls the switching unit in response to the sensor assembly unit, wherein the control unit enacts the switching unit to switch the heating unit on when the surface temperature is less than or equal to the dew point-derived value, and to switch the heating unit off when the surface temperature attains the ambient temperature.

2. The apparatus of claim 1, further comprising:

a door;

a door latch assembly; and a door latch cover assembly.

3. The apparatus of claim 2, wherein the sensor assembly unit is installed within an interior portion of the door latch cover assembly.

4. The apparatus of claim 1, wherein the control unit operates automatically.

5. The apparatus of claim 1, further comprising an electromechanical valve which is opened to activate the supplemental heat.

6. The apparatus of claim 1, wherein the supplemental heat comprises:

heat refrigeration gas.

7. The apparatus of claim 1, wherein the switching unit further comprises:

an electrical heater.

8. A method of controlling supplemental heat in a refrigerator or freezer comprising:

(a) reading a first surface temperature measurement of a cabinet surface of a refrigerator or freezer body;

(b) reading a first ambient temperature measurement;

(c) reading an ambient relative humidity measurement;

(d) calculating a dew point from the first ambient temperature measurement and the ambient relative humidity;

(e) making a first determination of whether the first surface temperature measurement is at a first acceptable level relative to the dew point;

(f) activating a heating unit if the first determination is not at the first acceptable level;

(g) reading a second surface temperature measurement of the cabinet surface;

(h) reading a second ambient temperature measurement;

(i) making a second determination of whether the second surface temperature measurement is at a second acceptable level relative to the second ambient temperature measurement; and (j) deactivating the heating unit if the second determination is at the second acceptable level.

9. The method of claim 8, further comprising continually supplying supplemental heat if the second surface temperature measurement is not equal to the second ambient temperature measurement.

10. A system for controlling supplemental heat in a refrigerator or freezer comprising:

means for reading a first cabinet surface temperature measurement adjacent to a seal of a door of the refrigerator or freezer body;

means for reading a first ambient temperature measurement;

means for reading an ambient relative humidity measurement;

means for calculating a dew point from the first ambient temperature measurement and the first ambient relative humidity measurement;

means for making a first determination of whether the first cabinet surface temperature measurement is at a first acceptable level relative to the dew point;

means for activating a heating unit if the first determination is not at the first acceptable level;

means for reading a second cabinet surface temperature measurement adjacent to the seal of the door of the refrigerator or freezer body;

means for reading a second ambient temperature measurement;

means for making a second determination of whether the second cabinet surface temperature is at a second acceptable level relative to the second ambient temperature measurement; and means for deactivating the heating unit if the second determination is at the second acceptable level.

11. The system of claim 10, further comprising:

means for continually supplying heat if the second cabinet surface temperature measurement is not equal to the second ambient temperature measurement.

12. The system of claim 10, wherein the means for reading a first cabinet surface temperature measurement and the means for reading a second cabinet surface temperature measurement comprise at least one surface temperature sensor.

13. The system of claim 10, wherein the means for reading a first ambient temperature measurement and the means for reading a second ambient temperature measurement comprise at least one ambient temperature sensor.

14. The system of claim 10, wherein the means for reading an ambient relative humidity measurement comprises an ambient relative humidity sensor.

15. The system of claim 10, wherein:

the means for reading a first ambient temperature measurement; and the means for reading an ambient relative humidity measurement are part of a sensor assembly unit.

* * * * *